US007926549B2

(12) United States Patent
Cooper et al.

(10) Patent No.: US 7,926,549 B2
(45) Date of Patent: Apr. 19, 2011

(54) DELIVERY NOZZLE WITH MORE UNIFORM FLOW AND METHOD OF CONTINUOUS CASTING BY USE THEREOF

(75) Inventors: W. Kent Cooper, Greencastle, IN (US); James Leacock McIntosh, Mason, OH (US); Peter Woodberry, Austinmer (AU); Rama B. Mahapatra, Brghton-Le-Sands (AU); Malcolm McDonald, Hartselle, AL (US)

(73) Assignee: Nucor Corporation, Charlotte, NC (US)

( * ) Notice: Subject to any disclaimer, the term of this patent is extended or adjusted under 35 U.S.C. 154(b) by 528 days.

(21) Appl. No.: 12/013,791

(22) Filed: Jan. 14, 2008

(65) Prior Publication Data

US 2008/0173424 A1 Jul. 24, 2008

Related U.S. Application Data

(60) Provisional application No. 60/885,778, filed on Jan. 19, 2007.

(51) Int. Cl.
*B22D 11/06* (2006.01)
*B22D 11/10* (2006.01)

(52) U.S. Cl. ..... 164/480; 164/428; 164/437; 164/488

(58) Field of Classification Search ..... 164/480, 164/428, 437, 488; 222/606, 607
See application file for complete search history.

(56) References Cited

U.S. PATENT DOCUMENTS 3,991,815 A 11/1976 Fastner et al.
4,487,251 A 12/1984 Cahoon et al.
5,227,078 A 7/1993 Augustine
5,402,993 A 4/1995 Hofmann et al.
5,691,061 A 11/1997 Hanse et al.
5,716,538 A 2/1998 Poloni et al.
5,785,880 A 7/1998 Heaslip et al.
5,840,206 A 11/1998 Gacher et al.

(Continued)

FOREIGN PATENT DOCUMENTS

AU 8036691 A 1/1992

(Continued)

OTHER PUBLICATIONS

PCT/AU2008/000064 International Search Report.

(Continued)

*Primary Examiner* — Kevin P Kerns
(74) *Attorney, Agent, or Firm* — Hahn Loeser & Parks LLP

(57) ABSTRACT

A method of and apparatus for casting metal strip involving assembling a pair of casting rolls laterally disposed to form a nip between them, assembling an elongated metal delivery nozzle extending along and above the nip between the casting rolls, with at least one segment having opposing side walls and end walls, an inner trough extending longitudinally within between side walls and forming passages between the side walls and the inner trough and communicating with side outlets adjacent bottom portions, introducing molten metal through the elongate metal delivery nozzle to form a casting pool of molten metal supported on the casting rolls above the nip, such that molten metal is caused to flow into the inner trough of the delivery nozzle, from the inner trough through the passages between the inner trough and sidewalls, and from the passages through the side outlets in a substantially lateral direction into the casting pool, and counter rotating the casting rolls to deliver cast strip downwardly from the nip.

12 Claims, 5 Drawing Sheets

U.S. PATENT DOCUMENTS

| | | | | |
|---|---|---|---|---|
| 5,857,514 | A | 1/1999 | Shook et al. | |
| 5,944,261 | A | 8/1999 | Heaslip et al. | |
| 5,958,280 | A | 9/1999 | Reichelt et al. | |
| 6,016,941 | A | 1/2000 | Damle | |
| 6,027,051 | A | 2/2000 | Heaslip et al. | |
| 6,220,335 | B1 * | 4/2001 | Folder et al. | 164/437 |
| 6,279,790 | B1 | 8/2001 | Nomura et al. | |
| 6,410,469 | B1 | 6/2002 | Hoover et al. | |
| 6,425,505 | B1 | 7/2002 | Heaslip et al. | |
| 6,464,154 | B1 | 10/2002 | Heaslip et al. | |
| 6,586,355 | B2 | 7/2003 | Hoover et al. | |
| 6,932,250 | B2 | 8/2005 | Bederka | |
| 7,063,242 | B2 | 6/2006 | Marti et al. | |
| 2005/0211411 | A1 * | 9/2005 | Fukase et al. | 164/480 |
| 2008/0264599 | A1 * | 10/2008 | Blejde et al. | 164/463 |

FOREIGN PATENT DOCUMENTS

| | | | |
|---|---|---|---|
| EP | 0 850 712 | B1 | 5/2001 |
| JP | 7-68356 | A * | 3/1995 |
| WO | 2005/077570 | A1 | 8/2005 |
| WO | 2007/056801 | A1 | 5/2007 |
| WO | 2007/087686 | A1 | 8/2007 |
| WO | 2008/086580 | A1 | 7/2008 |

OTHER PUBLICATIONS

PCT/AU2008/000064 Written Opinion.

* cited by examiner

DELIVERY NOZZLE WITH MORE UNIFORM FLOW AND METHOD OF CONTINUOUS CASTING BY USE THEREOF

This application claims priority to provisional application Ser. No. 60/885,778, filed Jan. 19, 2007, the disclosure of which is hereby incorporated by reference.

BACKGROUND AND SUMMARY OF THE INVENTION

This invention relates to making thin strip and more particularly casting of thin strip by a twin roll caster.

It is known to cast metal strip by continuous casting in a twin roll caster. Molten metal is introduced between a pair of counter-rotating horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or tundish/distributor, from which it flows through a metal delivery nozzle located above the nip, which directs the molten metal to form a casting pool supported on the casting surfaces of the rolls above the nip. This casting pool is typically confined at the ends of the casting rolls by side plates or dams held in sliding engagement adjacent the ends of the rolls.

In casting thin strip by twin roll casting, the metal delivery nozzles receive molten metal from the movable tundish and deposit the molten metal in the casting pool in a desired flow pattern. Previously, various designs have been proposed for delivery nozzles involving a lower portion submerged in the casting pool during a casting campaign, and having side openings through which the molten metal is capable of flowing laterally into the casting pool outwardly toward the casting surfaces of the rolls. Examples of such metal delivery nozzles are disclosed in U.S. Pat. No. 5,857,514 and U.S. Pat. No. 6,012,508. In prior art metal delivery nozzles, there has been a tendency to produce thin cast strip that contains surface defects and associated microcracking from uneven solidification at the chilled casting surfaces of the rolls.

The present invention provides a metal delivery nozzle that is capable of substantially reducing and inhibiting such surface defects and microcracks. By testing, we have found that a major cause of such defects is premature solidification of molten metal in the regions where the casting pool meets the casting surfaces of the rolls, generally known as the "meniscus" or "meniscus regions" of the casting pool. In these regions, if solidification occurs before the molten metal has made contact with the roll surface, irregular initial heat transfer can occur between the metal shell and the casting roll, resulting in formation of surface defects, such as depressions, ripple marks, cold shuts and/or microcracks. The temperature of the metal in the surface region of the casting pool between the rolls tends to be lower than that in the incoming molten metal. If the temperature of the molten metal at the pool surface in the region of the meniscus becomes too low then surface cracks and "meniscus marks" (i.e., marks on the strip caused by the meniscus freezing while the pool level is uneven) are likely to occur.

One way of dealing with such surface cracks and meniscus marks has been to increase the temperature of the incoming molten metal from the delivery nozzle, so that molten metal reaches the casting surfaces of the rolls before reaching solidification temperatures. Another approach has been to cause the incoming molten metal to be delivered relatively rapidly into the meniscus regions of the casting pool directly from the delivery nozzle. This avoided the tendency for premature solidification of the metal before it contacts the casting roll surfaces. This approach has been more effective in avoiding surface defects in the cast strip. Examples of this approach are to be seen in U.S. Pat. No. 5,875,514. This approach allows for cast strip without the formation of surface defects and cracks.

Nevertheless, the formation of pieces of solid metal known as "skulls" in the casting pool in the vicinity of the confining side plates or dams have been observed. The rate of heat loss from the melt pool is higher near the side dams due to conductive heat transfer through the side dams to the casting roll ends. This localized heat loss near the side dams has a tendency to form "skulls" of solid metal in that region, which can grow to a considerable size and fall between the casting rolls and causing defects in the cast strip. An increased flow of molten metal to these "triple point" regions, the regions near the side dams, have been provided by separate direct flows of molten metal to these triple point regions. Examples of such proposals may be seen in U.S. Pat. No. 4,694,887 and in U.S. Pat. No. 5,221,511. Increased heat input to these regions has inhibited formation of skulls.

U.S. Pat. No. 5,857,514 discloses a method and apparatus in which molten metal is delivered to the delivery nozzle in a trough closed at the bottom. Side openings are provided through which the molten metal flows laterally from the nozzle into a casting pool in the vicinity of the casting pool surface. The flow of molten metal into the casting pool was improved; however, unevenness in metal flow adjacent the casting roll surfaces tended to cause surface defects and surface cracks in the cast strip.

The present invention provides an improved delivery nozzle and method of casting thin strip with the delivery nozzle. Disclosed is a method of casting metal strip comprising:

(a) assembling a pair of casting rolls laterally disposed to form a nip between them;

(b) assembling an elongated metal delivery nozzle extending along and above the nip between the casting rolls, with at least one segment having opposing side walls and end walls, and an inner trough extending longitudinally between the side walls and forming passages between the side walls and the inner trough and communicating with side outlets adjacent bottom portions, (c) introducing molten metal through the elongate metal delivery nozzle to form a casting pool of molten metal supported on the casting rolls above the nip, such that molten metal is caused to flow into the inner trough of the delivery nozzle, from the inner trough through the passages between the inner trough and sidewalls, and from the passages through the side outlets in a substantially lateral direction into the casting pool, and (d) counter rotating the casting rolls to deliver cast strip downwardly from the nip.

Each segment of the metal delivery nozzle may be assembled with at least one partition extending between the side walls, and the passages between the inner trough and side walls extending between the partitions or between a partition and end wall.

Each segment of the metal delivery nozzle may be assembled with inner trough and side walls joined with a shoulder portion therebetween and the passages between the side walls and the inner trough formed by a plurality of holes through the shoulder portion.

Each segment of the metal delivery nozzle may be assembled with the inner trough and side walls in separate pieces, pinned together with ceramic pins. Protrusions may extend into the passages from the inner trough or side wall, or both, to cause turbulence in the molten metal flowing through the passages. The protrusions may be in at least two offset rows extending from the inner trough or side wall on one or both sides of the passages.

Also disclosed is a metal delivery apparatus for casting metal strip comprising a metal delivery nozzle having at least one elongated segment, each segment having opposing side walls and end walls, an inner trough extending along the side walls to form passages between the side walls and the inner trough, and communicating with side outlets adjacent bottom portions of the segments of the delivery nozzle extending along the segment, such that molten metal is capable of flowing into the inner trough, from the inner trough through the passages between the inner trough and sidewalls, and exit the delivery nozzle through the side outlets in a substantially lateral direction into a casting pool. Each segment of the metal delivery nozzle may be assembled with at least one partition extending between the side walls, and the passages between the inner trough and side walls and the related side outlets extending between the partitions or between a partition and an end wall.

Alternatively, disclosed is a metal delivery apparatus for casting metal strip comprising a metal delivery nozzle having at least one elongated segment, each segment having opposing side walls and an inner trough extending along the side walls to form a shoulder portion between the side walls and the inner trough, and a plurality of holes extending through each shoulder portion and communicating with side outlets adjacent bottom portions of the segments of the delivery nozzle extending along the segment, such that molten metal is capable of flowing into the inner trough, from the inner trough through the holes between the inner trough and sidewalls, and exit the delivery nozzle through the side outlets in a substantially lateral direction into a casting pool.

Alternatively, the metal delivery apparatus for casting metal strip may comprise a metal delivery nozzle having at least one elongated segment, each segment comprising an outer piece forming opposing side walls and end walls, and an inner trough forming an inlet to receive molten metal and passages between the side walls and the inner trough, such that molten metal is capable of flowing from the inner trough through the passages between the inner trough and sidewalls, and from the passages exiting the delivery nozzle through the side outlets in a substantially lateral direction into the casting pool.

Each segment of the metal delivery nozzle of metal delivery apparatus may be assembled with the inner trough and outer portion pinned together with ceramic pins. In addition, protrusions may extend into the passages from the inner trough or side wall, or both, to cause turbulence in the molten metal flowing through the passages. The protrusions may be in at least two offset rows extending from the inner trough or side wall on one or both sides of the passages.

In each embodiment of both the improved delivery nozzle and method of casting steel strip with the delivery nozzle, the inner trough dissipates a substantial part of the kinetic energy present in the molten metal by reason of movement through the metal delivery system from the tundish to the delivery nozzle. In addition, the resistance provided in the movement of the molten metal from the inner trough through the passages to the side outlets further reduces the kinetic energy in the molten metal before reaching the casting pool. As a result, a more uniform and more quiescent flow of molten metal is provided to the casting pool to formation of the cast strip.

Other embodiments of the invention will be apparent as following detailed description of the drawings and the claims proceeds.

BRIEF DESCRIPTION OF THE DRAWINGS

The invention is described in more detail in reference to the accompanying drawings in which.

DETAILED DESCRIPTION OF THE INVENTION

Figure 1:
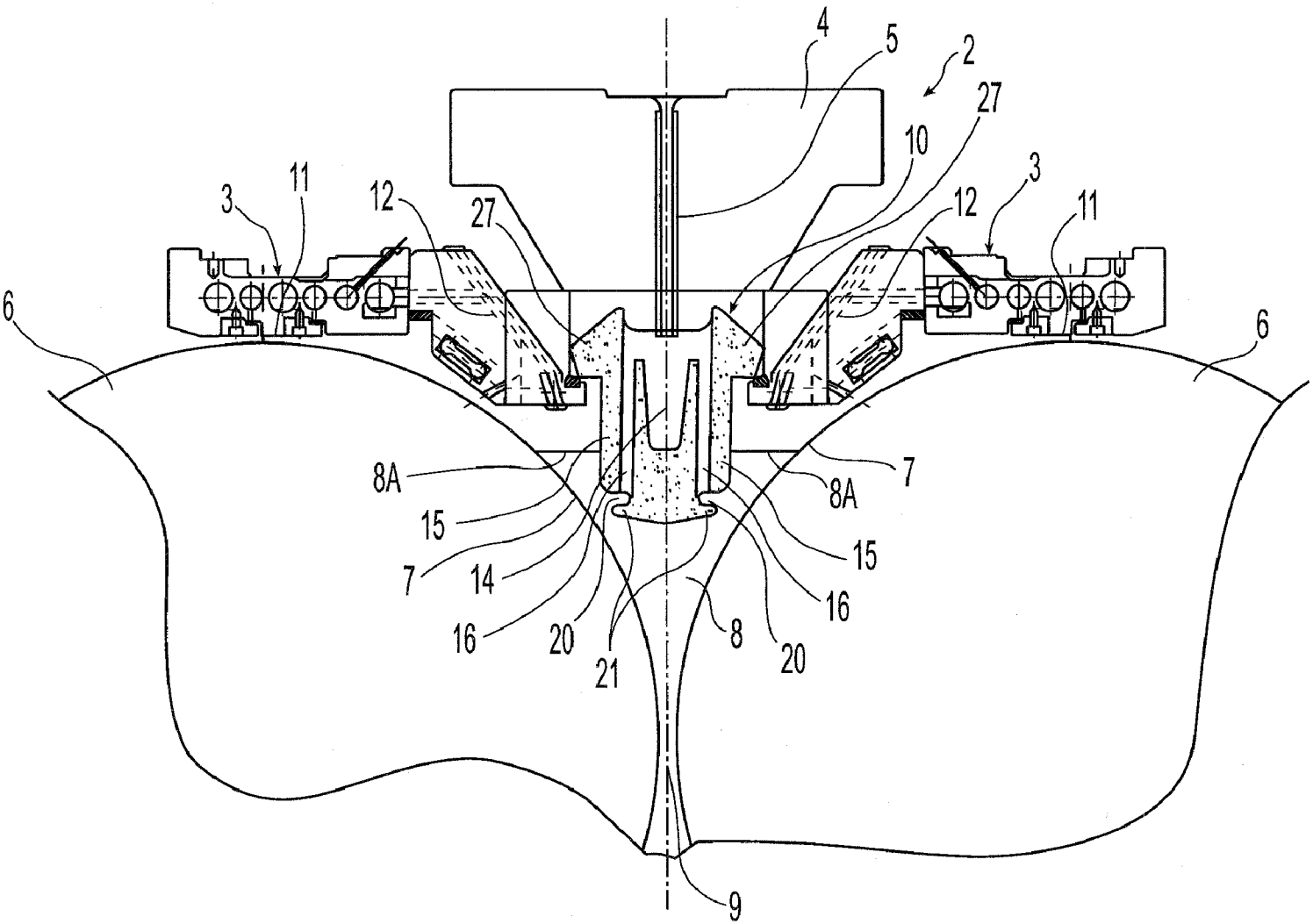
FIG. 1 illustrates a cross-sectional end view of a portion of twin roll strip caster with an assembled metal delivery nozzle.

Referring to FIG. 1, the metal strip casting apparatus 2 includes a metal delivery nozzle 10 located below a tundish 4 and above casting rolls 6. Casting rolls 6 are laterally positioned with nip 9 formed between them. Tundish 4 receives metal from a ladle (not shown) and delivers the molten metal to delivery nozzle 10. A shroud 5 may extend from tundish 4 and into delivery nozzle 10, for the purpose of transferring molten metal into delivery nozzle 10. In the alternative, tundish 4 may transfer metal to delivery nozzle 10 via a hole in the bottom of tundish 4. Below delivery nozzle 10, a casting pool 8 having surface 8A is formed supported on the casting surfaces 7 of casting rolls 6 adjacent nip 9. Casting pool 8 is constrained at the ends of the casting rolls and side dams or plates (not shown) positioned against the sides of the casting rolls. Delivery nozzle 10 controls molten metal flow into casting pool 8. Generally, delivery nozzle 10 extends into casting pool 8 during the casting campaign. Also shown in FIG. 1 is gas control apparatus 3 for maintaining a gas seal 11 with the casting surfaces 7 of casting rolls 6 and maintaining an inert atmosphere of nitrogen and/or argon above the casting pool 8 by blowing such gas through passageways 12 in gas control apparatus 3.

Figure 2:
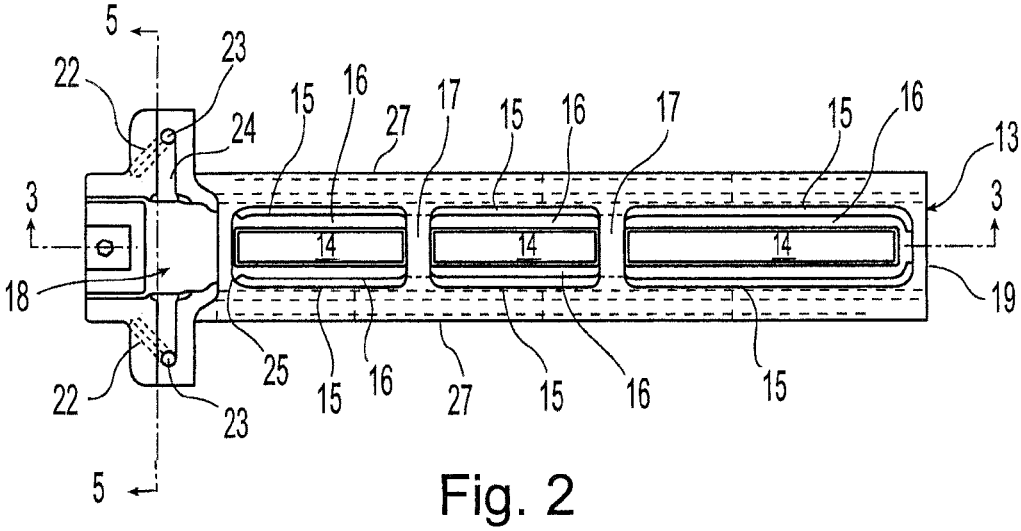
FIG. 2 is a plan view of a segment of metal delivery nozzle for use in the twin roll caster shown in FIG. 1.
Figure 3:
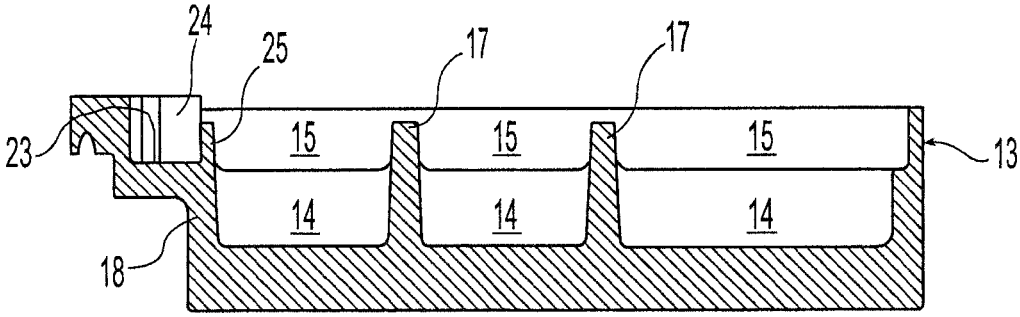
FIG. 3 is a cross-sectional side view taken along line 3-3 of the segment of the metal delivery nozzle shown in FIG. 2.

Referring to FIG. 2, delivery nozzle 10 comprises two segments 13 (one shown), with each segment 13 having opposing side walls 15 and an upward opening inner trough 14, which extend lengthwise along segment 13 in the longitudinal direction of delivery nozzle 10. Partitions 17 extend between side walls 15 at spaced locations along each segment 13, and provide structural support for the segment 13 of the delivery nozzle 10 when loaded with molten metal in operation. Passages 16 are formed between the side walls 15 and inner trough 14. Passages 16 extend between partitions 17 or between a partition 17 and end walls 18 or 19 along the length of the segment 13. Passages 16 extend to side outlets 20 at the bottom portion 21 of the segment 13.

The pair of segments 13 may be assembled lengthwise with the end walls 19, in abutting relation, and end walls 18 forming the ends of delivery nozzle 10. Alternatively, delivery nozzle 10 may comprise a single segment 13, or more than two segments 13, that include all the features of, and effectively functions as, the assembled pair of segments 13 as described herein. Segments 13 may be made of any refractory material, such as alumina graphite. Further, segment 13 may include partitions 17, extending between side walls 15 to strengthen segment 13 under load of molten metal during a casting campaign. As shown in FIG. 1, each segment 13 includes mounting flanges 27 that extend outward from side walls 15, either continuously (as shown in FIG. 2) or intermittently, as desired, to mount segments 13 to assemble the delivery nozzle 10 in the casting apparatus 2.

In operation, molten metal is poured from the tundish 4 through shroud 5 into the inner trough 14 of mounted segments 13 of the delivery nozzle 10. Several shrouds 5 may be provided along the length of the segments 13 of the delivery nozzle 10. The molten metal flows from the inner trough 14 into and through passages 16 to the side outlets 20. The side outlets 20 direct the flow of molten metal to discharge the molten metal laterally into the casting pool 8 in the direction of the meniscuses between the surface 8A of the casting pool 8 and the casting surfaces 7 of the casting rolls 6. Since the passages 16 and side outlets 20 extend along both sides of the segments 13, except at the partitions 17, a relatively uniform flow of molten metal can be provided along the length of the segments 13.

Figure 4:
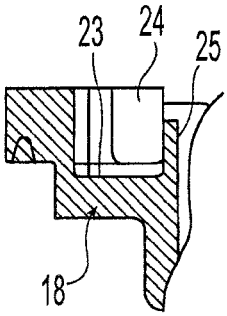
FIG. 4 is an enlarged section of the triple section of the segment of the metal delivery nozzle shown in FIGS. 2 and 3.
Figure 5:
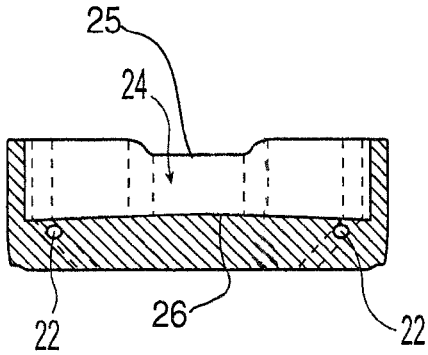
FIG. 5 is a cross-sectional transverse taken along line 5-5 of the segment of the metal delivery nozzle shown in FIG. 2.

Referring to FIGS. 2-5, the assembly of the end portion 18 of the segment 13 positioned adjacent one of the ends of the casting rolls 6 is illustrated. This is called the "triple point" region and is the area where skulls are more likely to form because of the different heat gradient adjacent a side dam. To compensate, molten metal is directed into the "triple point" region through slanted passageways 22 through the end portion 18 as shown in FIG. 2 through outlets 23 from reservoir 24, which is positioned transverse to the end portion 18 of the segment 13. The shape of the reservoir 24 is shown in FIGS. 4 and 5, with a bottom portion 26 shaped to cause the molten metal to flow toward the outlets 23 and into the passageways 22. A weir 25 is also provided in the segment 13 to separate the flow of molten metal in the reservoir 24 into the "triple point" region, while allowing flow of molten metal from the inner trough 14 currently as the metal flows into the passages 16. The height of the weir 25 is selected to provide most effective flow of molten metal at a higher effective temperature into the "triple point" region to balance the difference in heat gradient in the "triple point" region.

Figure 6:
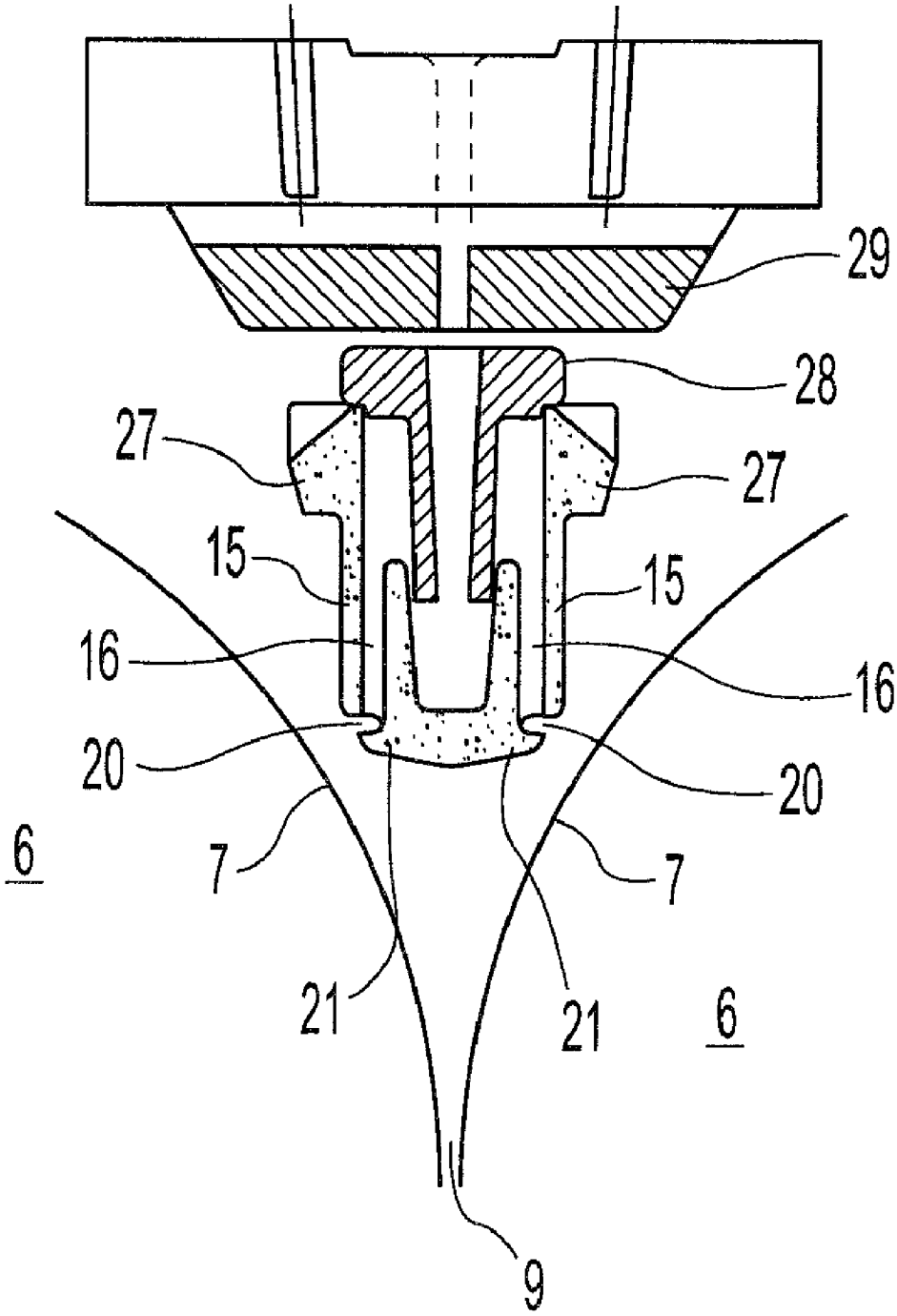
FIG. 6 is a cross-sectional transverse view of a portion of twin roll caster illustrating an alternative embodiment of an assembled metal delivery nozzle.

Referring to FIG. 6, an alternative embodiment of the segment 13 is shown that is the same as that shown in FIG. 1 except that inner trough 14 is shallower and the passages 16 are shorter. To assist in directing the molten metal from the tundish 4 into inner trough 14 of the segment 13, a separate shroud piece 28 is provided positioned on segment 13 and another separate shroud piece 29 is positioned on the tundish 4. This embodiment reduces the resident time of the molten metal in the delivery nozzle 10, and provides more direct relation of the temperature of the molten metal in the tundish 4 and the casting pool 8.

Figure 7:
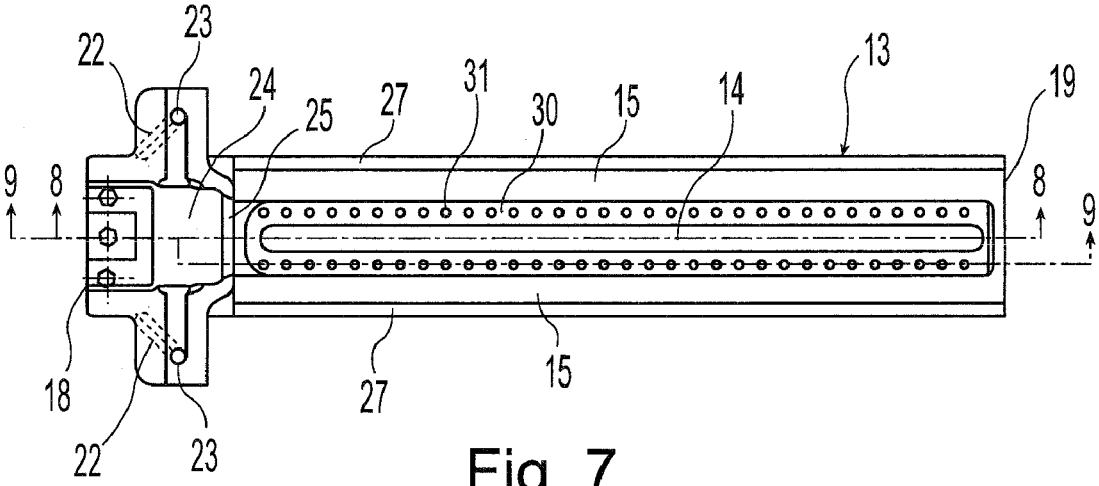
FIG. 7 is a plan view of a segment of an alternative metal delivery nozzle for use in a twin roll caster.
Figure 8:
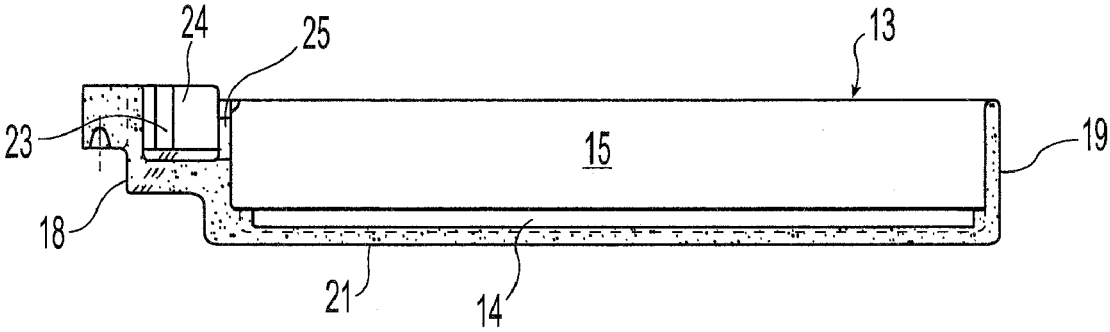
FIG. 8 is a cross-sectional taken along line 8-8 of the segment of the metal delivery nozzle shown in FIG. 7.
Figure 9:
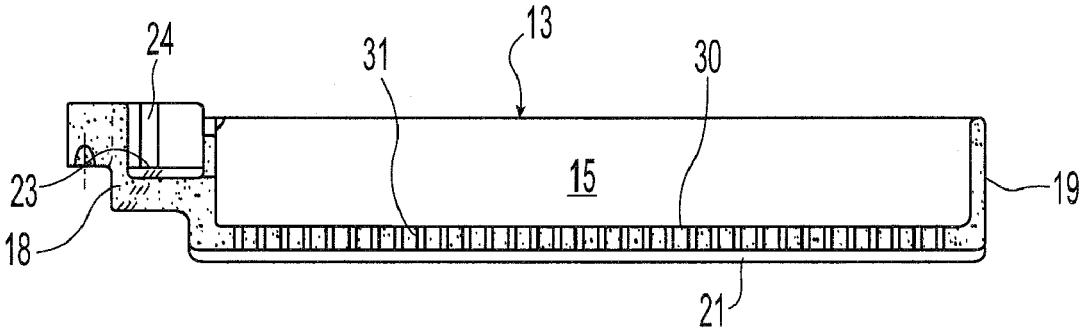
FIG. 9 is a cross-sectional taken along line 9-9 of the segment of the metal delivery nozzle shown in FIG. 7.

Referring to FIGS. 7-9, another alternative embodiment of the segment 13 for the delivery nozzle 10 is illustrated. In this embodiment, the side walls 15 are joined to the inner trough 14 to form shoulder portions 30, and the passages 16 are in the form of holes 31 extending through the shoulder portion 30 along each side of the inner trough 14. The molten metal flows from the inner trough 14 through the holes 31 to the side outlets 20. In this embodiment, the shoulder portion 30 provides the structural support to the segment 13 when the delivery nozzle 10 is loaded with molten metal during a casting campaign. Partitions 17 are not needed to provide structural support for the segment 13. As a result, the flow of molten metal from the side outlets 20 into the casting pool 8 can be provided laterally more evenly along the segment 13. The assembly of the segments 13 of the metal delivery nozzle 10 is otherwise generally the same as that described above with reference to FIGS. 1-5.

Figure 10:
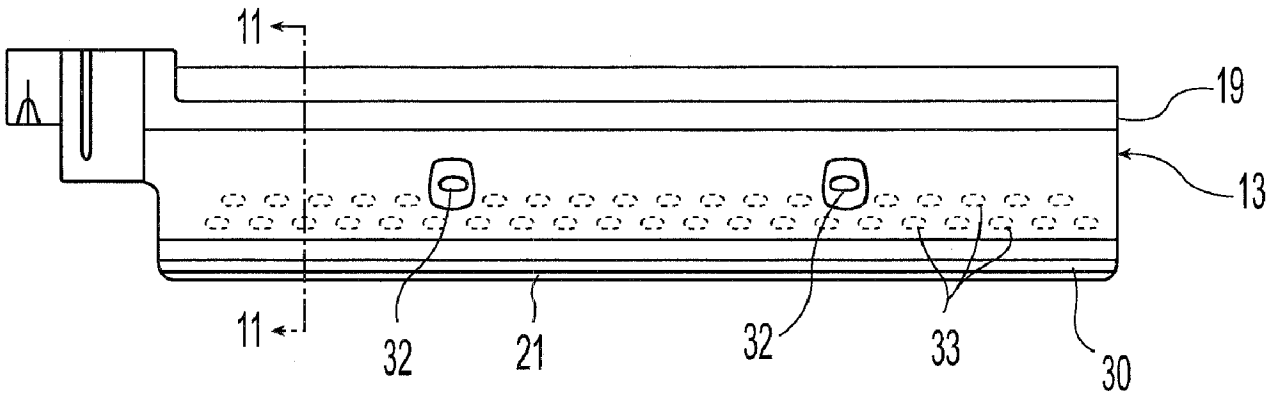
FIG. 10 is a side view of the segment of another alternative embodiment of metal delivery nozzle.
Figure 11:
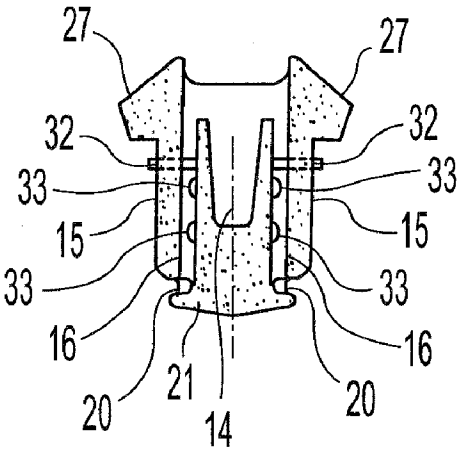
FIG. 11 is a cross-sectional transverse taken along line 11-11 of the segment of the metal delivery nozzle shown in FIG. 10.

Referring to FIGS. 10 and 11, each segment 13 of the delivery nozzle 10 is assembled in two pieces, with one piece being the inner trough 14 and the bottom portion 21 as shown in FIG. 11. The other piece includes all of the other parts of the segment 13 as described above with reference to FIGS. 1-5. The two pieces are assembled together by use of ceramic pins 32, which extend through holes on the side walls 15 and into or through holes in the side portions of the inner trough 14. The ceramics pins provide structural support for the segments 13 and the assembled delivery nozzle 10 when the delivery nozzle is loaded with molten metal during a casting campaign.

In the embodiment shown FIGS. 10 and 11, two or more offset rows of protrusions 33 are provided in the outside wall of inner trough 14. The protrusions 33 extend into passages 16 to provide a serpentine path to the flow of molten metal through passages 16 to the side outlets 20. Alternatively, some or all of the protrusions 33 may be provided in the inside wall of side walls 15 as desired in the embodiment. The assembly of the segments 13 of the metal delivery nozzle 10 is otherwise generally the same as that described above with reference to FIGS. 1-5.

It should be understood that the above described apparatus and method of casting thin strip are the presently contemplated best modes of embodying the invention. It is to be understood that these and other embodiments may be made and performed within the scope of the following claims. In each embodiment of the delivery nozzle, the inner trough dissipates a substantial part of the kinetic energy built up in the molten metal by reason of movement through the delivery system from the tundish to the delivery nozzle, and the resistance to movement of the molten metal from the inner trough through the passages to the side outlets further reduces the kinetic energy in the molten metal from the molten metal before reaching the casting pool. As a result, a more uniform and more quiescent flow of molten metal is provided to the casting pool to formation of the cast strip.

We claim:

1. A method of casting metal strip comprising:

(a) assembling a pair of casting rolls laterally disposed to form a nip between them, (b) assembling an elongated metal delivery nozzle extending along and above the nip between the casting rolls, with at least one segment having opposing side walls and end walls, and an inner trough extending longitudinally between the side walls and forming passages between the side walls and the inner trough and communicating with side outlets adjacent bottom portions, (c) assembling each segment of the metal delivery nozzle with at least one partition extending between the side walls, and the passages between the inner trough and side walls extending between the partitions or between a partition and end wall, (d) introducing molten metal through the elongated metal delivery nozzle to form a casting pool of molten metal supported on the casting rolls above the nip, such that molten metal is caused to flow into the inner trough of the delivery nozzle, from the inner trough through the passages between the inner trough and side walls, and from the passages through the side outlets in a substantially lateral direction into the casting pool, and (e) counter rotating the casting rolls to deliver cast strip downwardly from the nip.

2. The method as claimed in claim 1 further comprising assembling each segment of the metal delivery nozzle with the inner trough and side walls joined with a shoulder portion therebetween and the passages between the side walls and the inner trough formed by a plurality of holes through the shoulder portion.

3. The method as claimed in claim 1 further comprising assembling each segment of the metal delivery nozzle with the inner trough and side walls in separate pieces, pinned together with ceramic pins.

4. The method as claimed in claim 1 where the step of assembling each segment of the metal delivery nozzle comprises assembling each segment of the metal delivery nozzle with protrusions extending into the passages from the inner trough or the side walls, or both, to cause turbulence in the molten metal flowing through the passages.

5. The method as claimed in claim 1 where the step of assembling each segment of the metal delivery nozzle comprises assembling each segment of the metal delivery nozzle with protrusions in at least two offset rows extending into the passages from the inner trough or side wall, or both.

6. A method of casting metal strip comprising:

(a) assembling a pair of casting rolls laterally disposed to form a nip between them, (b) assembling an elongated metal delivery nozzle extending along and above the nip between the casting rolls, with at least one segment having opposing side walls and end walls, and an inner trough extending longitudinally between the side walls and forming passages between the side walls and the inner trough and communicating with side outlets adjacent bottom portions, (c) assembling each segment of the metal delivery nozzle with the inner trough and side walls joined with a shoulder portion therebetween and the passages between the side walls and the inner trough formed by a plurality of holes through the shoulder portion, (d) introducing molten metal through the elongated metal delivery nozzle to form a casting pool of molten metal supported on the casting rolls above the nip, such that molten metal is caused to flow into the inner trough of the delivery nozzle, from the inner trough through the passages between the inner trough and side walls, and from the passages through the side outlets in a substantially lateral direction into the casting pool, and (e) counter rotating the casting rolls to deliver cast strip downwardly from the nip.

7. The method as claimed in claim 6 further comprising assembling each segment of the metal delivery nozzle with the inner trough and side walls in separate pieces, pinned together with ceramic pins.

8. The method as claimed in claim 6 where the step of assembling each segment of the metal delivery nozzle comprises assembling each segment of the metal delivery nozzle with protrusions extending into the passages from the inner trough or the side walls, or both, to cause turbulence in the molten metal flowing through the passages.

9. The method as claimed in claim 6 where the step of assembling each segment of the metal delivery nozzle comprises assembling each segment of the metal delivery nozzle with protrusions in at least two offset rows extending into the passages from the inner trough or side wall, or both.

10. A method of casting metal strip comprising:

(a) assembling a pair of casting rolls laterally disposed to form a nip between them, (b) assembling an elongated metal delivery nozzle extending along and above the nip between the casting rolls, with at least one segment having opposing side walls and end walls, and an inner trough extending longitudinally between the side walls and forming passages between the side walls and the inner trough and communicating with side outlets adjacent bottom portions, (c) assembling each segment of the metal delivery nozzle with the inner trough and side walls in separate pieces, pinned together with ceramic pins, (d) introducing molten metal through the elongated metal delivery nozzle to form a casting pool of molten metal supported on the casting rolls above the nip, such that molten metal is caused to flow into the inner trough of the delivery nozzle, from the inner trough through the passages between the inner trough and side walls, and from the passages through the side outlets in a substantially lateral direction into the casting pool, and (e) counter rotating the casting rolls to deliver cast strip downwardly from the nip.

11. The method as claimed in claim 10 where the step of assembling each segment of the metal delivery nozzle comprises assembling each segment of the metal delivery nozzle with protrusions extending into the passages from the inner trough or the side walls, or both, to cause turbulence in the molten metal flowing through the passages.

12. The method as claimed in claim 10 where the step of assembling each segment of the metal delivery nozzle comprises assembling each segment of the metal delivery nozzle with protrusions in at least two offset rows extending into the passages from the inner trough or side wall, or both.

* * * * *